United States Patent [19]

Roach, II

[11] 4,392,032

[45] Jul. 5, 1983

[54] ROTATING PADDLE BIN LEVEL INDICATOR

[75] Inventor: Donald E. Roach, II, Marysville, Mich.

[73] Assignee: Berwind Corporation, Philadelphia, Pa.

[21] Appl. No.: 258,058

[22] Filed: Apr. 28, 1981

[51] Int. Cl.[3] ..... H01H 35/00; G08B 21/00

[52] U.S. Cl. ..... 200/61.21; 340/617; 340/663

[58] Field of Search ..... 340/617, 611, 663, 615; 200/61.21, 61.2; 318/482; 310/68 B

[56] References Cited

U.S. PATENT DOCUMENTS

| | | | |
|---|---|---|---|
| 2,116,075 | 5/1938 | Lenhart | 200/61.21 |
| 2,851,553 | 9/1958 | Grostick | 200/61.21 |
| 2,909,766 | 10/1959 | Bozich | 200/61.21 X |
| 3,210,493 | 10/1965 | Lau | 200/61.2 |
| 3,210,495 | 10/1965 | Lau | 200/61.21 |
| 3,322,403 | 5/1967 | Murphy | 366/247 |
| 3,436,059 | 4/1969 | Donaldson | 340/617 X |
| 3,510,861 | 5/1970 | McIver et al. | 200/61.21 X |
| 3,542,982 | 11/1970 | Gruber | 200/61.21 |
| 3,721,971 | 3/1973 | Gruber | 200/61.21 X |
| 3,818,159 | 6/1974 | Evans et al. | 200/61.21 |
| 3,941,956 | 3/1976 | Delin et al. | 200/61.2 |
| 4,095,064 | 6/1978 | Fleckenstein | 200/61.21 |
| 4,147,906 | 4/1979 | Levine | 200/61.2 |
| 4,211,966 | 7/1980 | Sweet | 340/617 X |

OTHER PUBLICATIONS

Monitor Mfg. Co.—sales brochure, "Monitor Automatic Level Indicators" (1976), pp. 1, 2 and 9.

*Primary Examiner*—John W. Caldwell, Sr.
*Assistant Examiner*—Daniel Myer
*Attorney, Agent, or Firm*—Barnes, Kisselle, Raisch, Choate, Whittemore & Hulbert

[57] ABSTRACT

Apparatus for indicating the level of flowable material in a storage bin comprising a motor rotatably suspended by a spring within a protective enclosure and a drive shaft coupled by a ball-and-detent clutch to a paddle disposed within the bin to engage material therein. When the material reaches the level of the paddle, the drag on the paddle causes the motor to rotate within the enclosure and thereby to activate a switch disposed within the enclosure and coupled to the motor. A spring returns the motor to the switch-deactivated position when the material level decreases and the consequent drag is removed from the paddle. Electronic circuitry disposed within the housing includes field-selectable fail-safe circuitry for indicating either a high or a low material condition in the event of a power failure or the like independently of actual material level.

8 Claims, 5 Drawing Figures

ROTATING PADDLE BIN LEVEL INDICATOR

The present invention relates to bin level indicators, and more particularly to an improved apparatus of the rotating paddle type for indicating the level of flowable material in a storage tank or bin.

Bin level indicators of the above-noted type typically comprise a motor carried for limited rotation within a protective enclosure and connected to a rotatable paddle which is adapted to engage flowable material within a storage bin when the material rises to the bin level at which the rotating paddle is disposed. The material drag on the paddle causes the motor drive torque to rotate the motor rather than the paddle, which rotation is normally sensed by one or more switches carried within the enclosure. The switches may be connected to deactivate a conveyor feeding material to the bin, to remove power from the indicator motor and/or to perform other control functions related to material level. Two examples of bin level indicators of the described type are shown in the U.S. patents of Grostick Nos. 2,851,553 and Gruber 3,542,982.

It is an object of the present invention to provide an improved rotating paddle bin level indicator which is more economical to fabricate and assemble than are prior art indicators of similar type. In furtherance of the object stated immediately above, it is another object of the invention to provide an improved rotating paddle bin level indicator which has a reduced number of component parts, and in which component parts may be either purchased as standard off-the-shelf elements or may be fabricated at minimum expense.

Another important and yet more specific object of the present invention is to provide a rotating paddle bin level indicator which includes a so-called "fail safe" feature for automatically indicating a predetermined material level—i.e., either high or low material level—independently of actual material level in the event of a power or motor failure. A further and related object of the invention is to provide such fail safe feature which is selectable in the field for indicating either a high level or a low level material condition in the event of failure as described.

The invention, together with additional objects, features and advantages thereof, will be best understood from the following description, the appended claims and the accompanying drawings in which:

Figure 1:
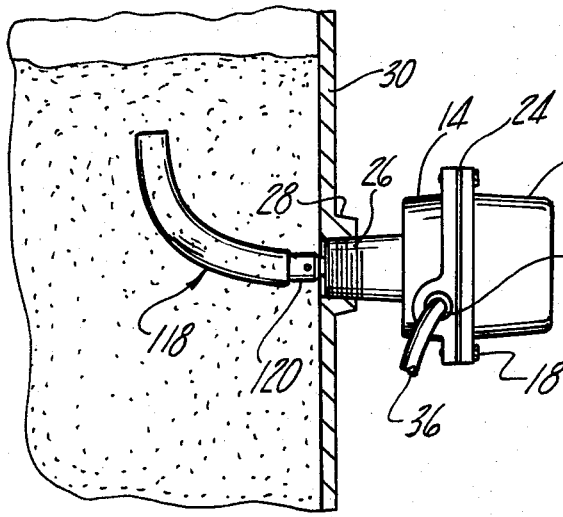
FIG. 1 is an elevational view, partly in section, showing a presently preferred embodiment of the bin level indicator provided by the invention.
Figure 2:
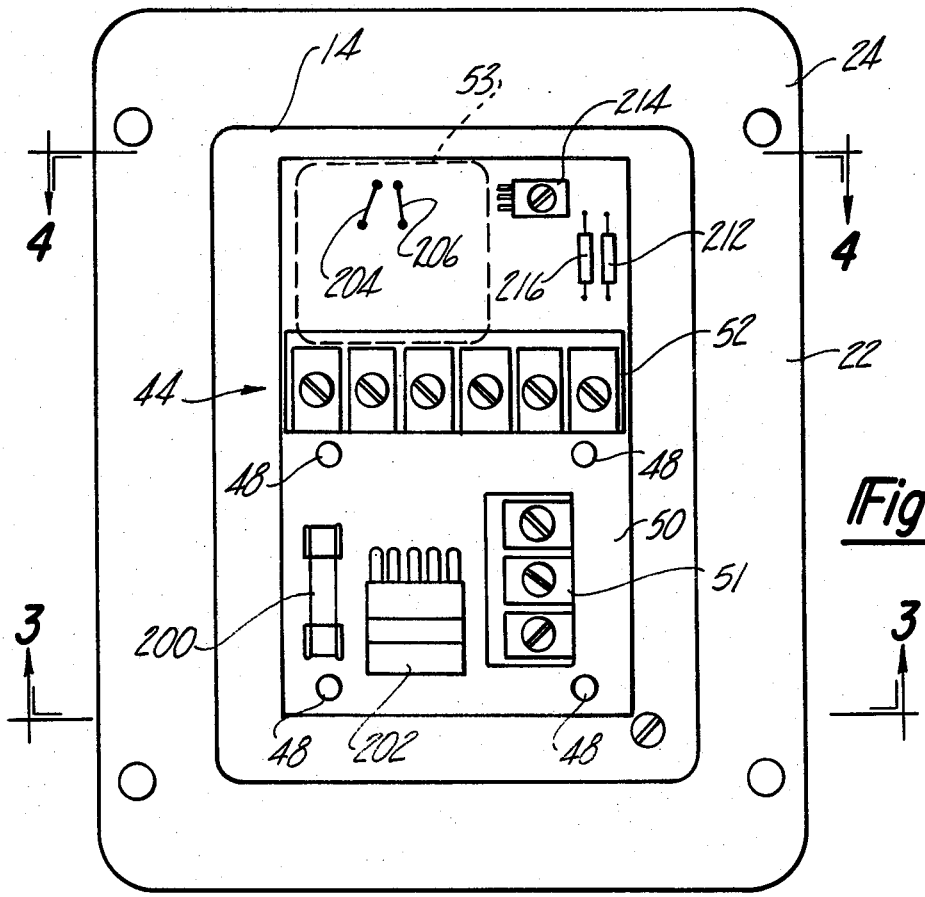
FIG. 2 is a plan view of the indicator shown in FIG. 1 with the cover removed.
Figure 3:
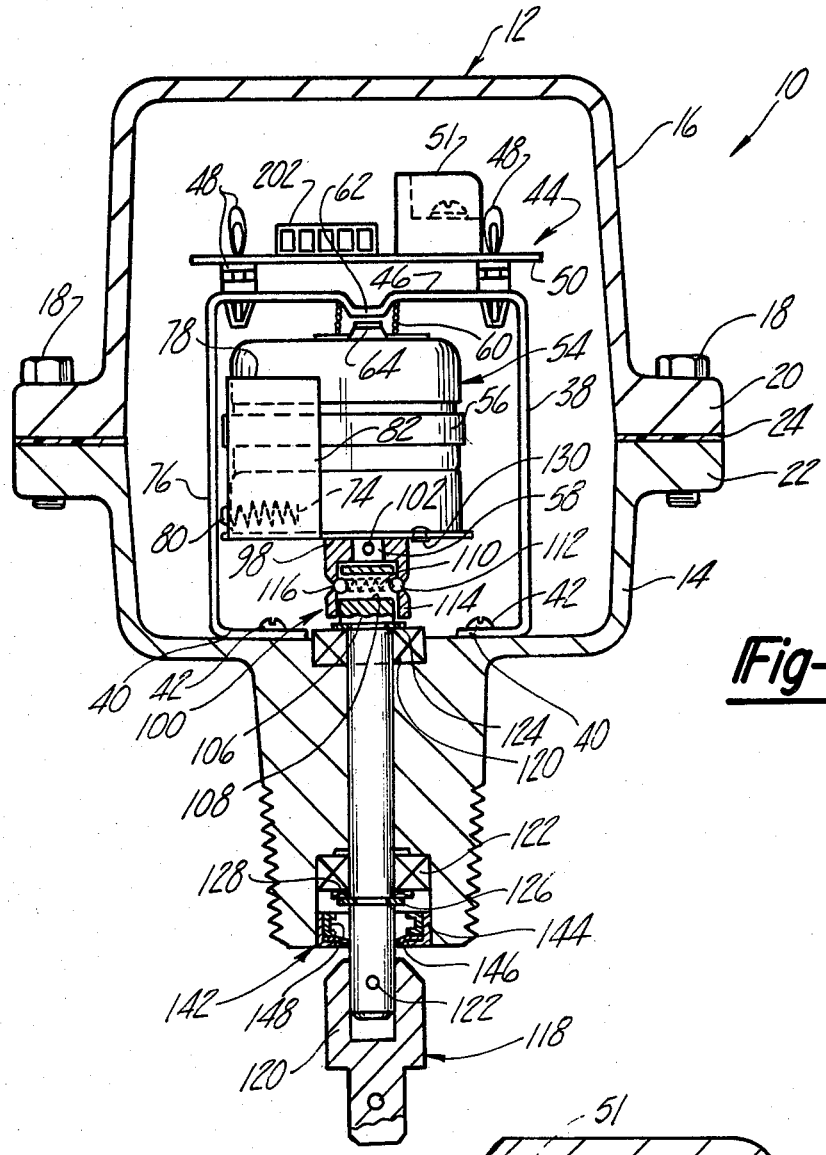
Figure 4:
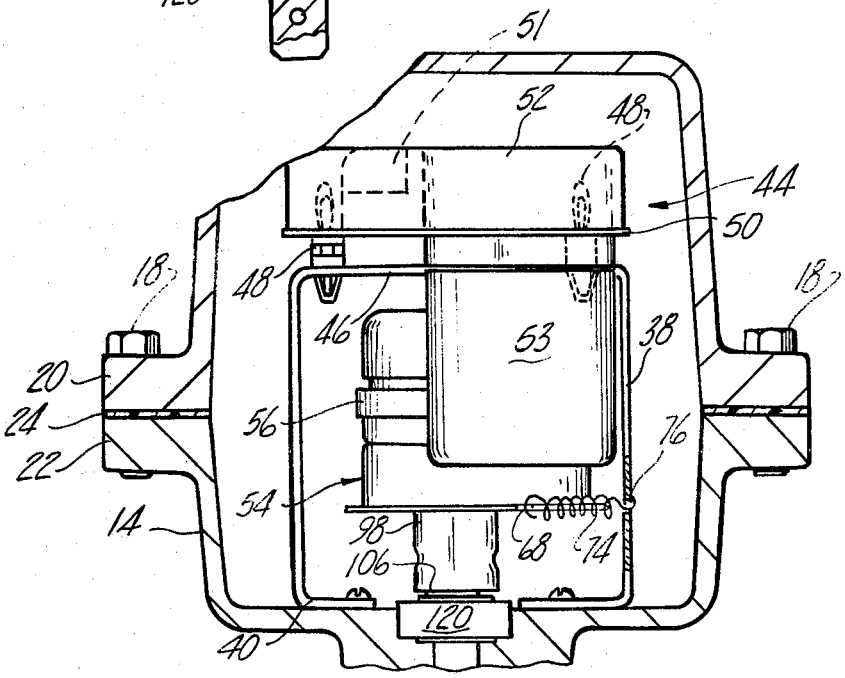
Figure 5:
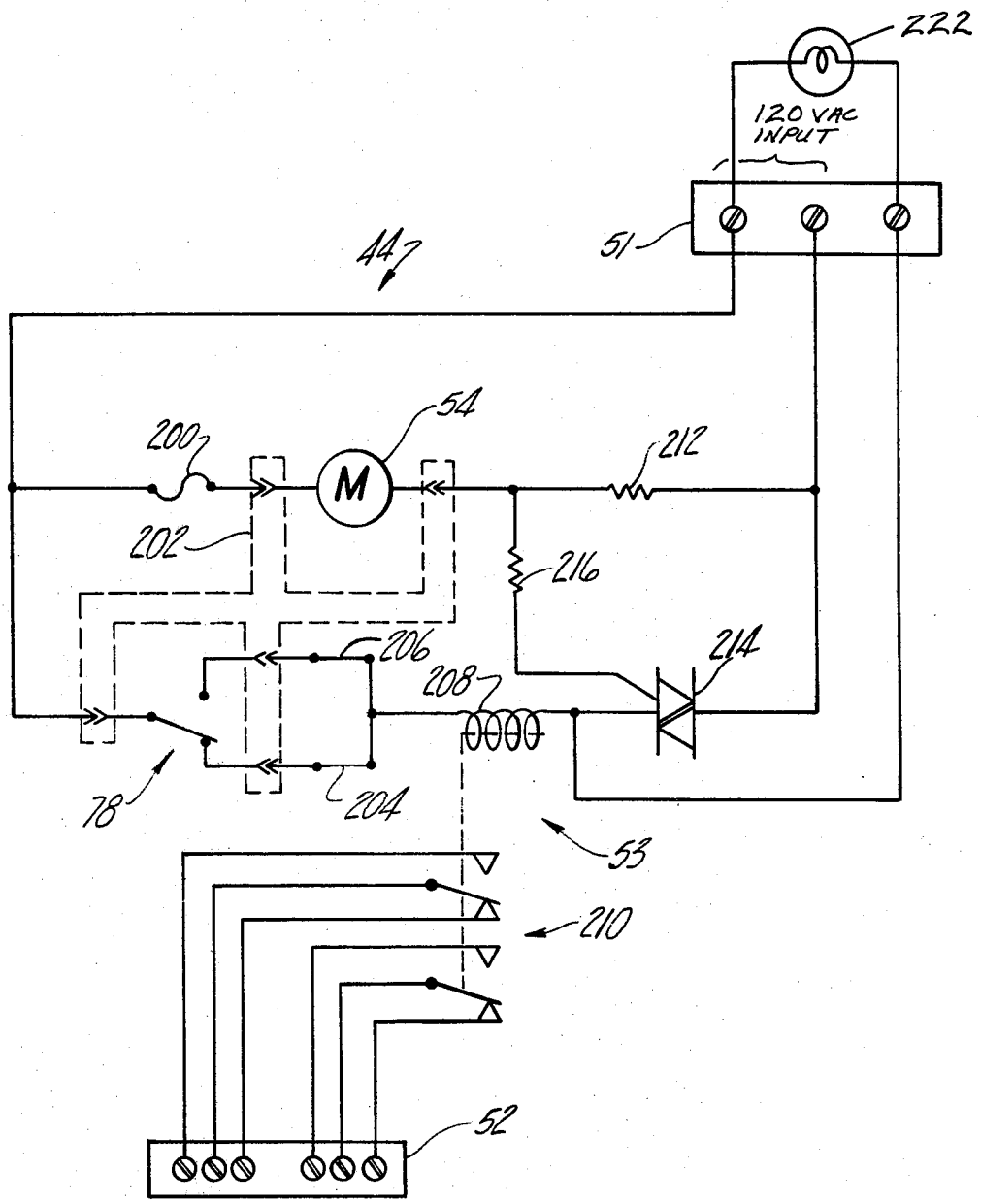

FIGS. 3 and 4 are fragmentary side sectional views of the indicator shown in FIGS. 1 and 2 taken substantially along the respective lines 3—3 and 4—4 in FIG. 2; and FIG. 5 is an electrical schematic diagram of the preferred embodiment of the invention shown in FIGS. 1-4.

Referring to FIGS. 1-4, a presently preferred embodiment 10 of the bin level indicator provided by the present invention includes a generally rectangular protective housing or enclosure 12 comprising a shallow cup-shaped enclosure base 14 and a deeper cup-shaped enclosure top or cover 16. Cover 16 is mounted to base 14 by bolts 18 extending through apertures in a radially extending flange 20 on cover 16 into threaded apertures in a corresponding base flange 22. A sealing gasket 24 is disposed between the respective flanges. A hollow externally threaded nipple 26 extends outwardly from base 14 and is adapted to be threadably received in a corresponding internally threaded gland 28 (FIG. 1) carried by the wall of a material storage tank or bin 30. An internally threaded laterally opening hole 32 (FIG. 1) is formed adjacent base flange 22 to receive a strain relief grommet or the like through which is fed a multiple-conductor electrical cable 36 adapted for connection to level indicating apparatus (not shown) disposed externally of enclosure 12.

Internally, indicator 10 includes an open generally C-shaped bracket 38 having lower flanges 40 mounted by screws 42 to base 14. An electronics assembly 44 is carried above the upper bridging portion 46 of bracket 38 by the spacers 48 received by snap fit into corresponding openings on bracket 38. Electronics assembly 44 includes a pair of terminal blocks 51,52 mounted on an upper surface of a planer circuit board 50 and a relay assembly 53 suspended beneath circuit board 50. Electronics assembly 44, including relay assembly 53, will be described in greater detail hereinafter in connection with FIG. 5.

A motor 54 is carried within enclosure 12 and comprises a generally cylindrical motor housing 56 having a rotatable shaft 58 (FIG. 3) extending axially from one end thereof eccentrically of housing 56. A coiled spring 60 is disposed between motor housing 56 and bracket bridge portion 46 positioned thereabove. Spring 60 is held in axial alignment with shaft 58 by a boss or eye 62 extending downwardly from bracket portion 48 into the spring coils and by an opposing boss 64 extending upwardly from the motor housing. The motor 54 shown in the drawings is purchased from Hansen Manufacturing Company, of Princeton, Ind. under part No. 34668RK247RL and includes a number of apertured ears extending radially outwardly from a portion of the housing 56 adjacent shaft 58. A coil spring 74 (FIG. 4) extends between an aperture 76 in bracket 38 and a housing ear 68 to bias motor housing to a normal or rest position shown in the drawings.

A switch 78 is mounted by an L-shaped bracket 82 (FIG. 3) to motor housing 56 and has a switch actuator button 80 extending laterally toward an opposing edge or surface of bracket 38. In the normal or rest position of motor 54, actuator button 80 is spaced from the opposing bracket 38, as best seen in FIG. 3. However, when motor shaft 58 is held against rotation by material engaging paddle 118 (FIG. 1), motor housing 56 rotates against the force of spring 74 until button 80 abuts bracket 30 to actuate switch 78. Spring 74 will return motor housing 56 to the normal or rest position upon removal of material drag from the motor shaft as hereinabove described, thereby causing deactivation of switch 78.

Drive shaft 58 has a forked end received in the collar element 98 of a ball-and-detent clutch assembly 100 (FIG. 3) and is rotatably coupled thereto by means of a pin 102 extending across collar 98. A paddle drive shaft 104 terminates internally of enclosure 12 in a hub 106 having a cylindrical bore 108 extending diametrically therethrough. A coil spring 110 and a pair of balls 112 are disposed in hub hole 108 with the balls 112 protruding radially from opposite ends of the hole in the rest condition of spring 110. Clutch collar 98 has an axially extending flange 114 which surrounds hub 106. A pair of holes 116 are formed radially in the flange opposite remote ends of holes 108 to receive the protruding portions of the respective balls 112. As clutch collar 98 is axially assembled over drive shaft hub 106, spring 110 and balls 112 are forced radially inwardly such that the spring is in compression and holds the balls in yieldable engagement with the corresponding flange holes 116.

During normal operation, balls 112 remain engaged with the corresponding holes 116 in clutch collar 98 and the rotary motion of motor shaft 58 is transmitted through the clutch assembly 100 to drive shaft 104. Should rotation of drive shaft 104 be impeded by impact of material in contact with paddle 118 (FIG. 1) directly coupled thereto, the tendency of motor shaft 58 and clutch collar 98 to continue rotating relative to shaft hub 106 forces balls 112 to roll over the edges of holes 116 in clutch collar flange 114 so as to be driven radially inwardly against the force of spring 110 to a retracted position in hub bore 108. Thus, excessive torque on motor shaft 58 causes the balls and the flange holes to become disengaged, whereby motor shaft 58 is free to rotate. Clutch 100 thereby disengages the paddle and drive shaft from the motor in the event of shock loading of the paddle by impact of material thereon. This safety arrangement prevents damage to the motor internal gear train. After 180° of motor shaft rotation, the balls 112 again register with the apertures 116 in clutch collar 98. The balls will again disengage from the clutch collar if rotation of drive shaft 104 is still impeded, such repetitive engagement and disengagement continuing until the resistance to rotation of the drive shaft and the clutch collar drops below a value corresponding to the torque transmission limit of clutch assembly 100.

Drive shaft 104 extends through the roller bearings 120,122 which are press-fitted into corresponding recesses in enclosure mounting nipple 26, and is axially positioned therein by the retaining rings 124,126 received in corresponding grooves in the drive shaft on respectively opposite sides of bearings 120,122. An annular leaf spring or belleville washer 128 is captured between retaining ring 126 and bearing 122 to absorb axial shock on the drive shaft caused by rocks or the like striking paddle 118. Thus, drive shaft 104 is held in fixed axial position with respect to apparatus enclosure 12, and motor 54 effectively floats within the enclosure. More specifically, motor housing 56 is biased by spring 60 into face-to-face axial engagement with clutch collar 98 with a thrust washer bearing 130 being disposed therebetween. Thus, motor 54 is effectively vibrationally isolated from housing 12 and is free to float relative thereto by the relatively loose fit of shaft forked end 98 over pin 102 and by the shock-absorbing spring 60.

A sealing assembly 142 is press-fitted into the housing-remote end of gland 26 and comprises a collar 144 having a radially inwardly directed channel which receives a resilient lip-sealing element 146 and an annular spacer element 148 which firmly pinches an end of sealing element 146 within the collar. Paddle 118 shown in FIG. 1 terminates in a collar 120 (FIG. 2) which is rotatably coupled by a pin 122 to an end of drive shaft 104 received telescopically therein. Paddle 118 per se is the subject of the U.S. patent to Fleckenstein No. 4,095,064 assigned to the assignee hereof. Bin level indicator 10, to the extent thus far described, with the exception of electronics assembly 44 to be described in detail hereinafter, is similar in many important respects to that which is the subject of the U.S. patent to Levine No. 4,147,906 which is also assigned to the assignee hereof. The disclosures of both said patents to Fleckenstein and Levine are incorporated herein by reference.

FIG. 5 is a schematic diagram of electronics assembly 44 shown in FIGS. 2–4. It will be understood and appreciated that the various conductors shown schematically in FIG. 5, which are generally in the form of conductive foils etched onto board 50 and suitable lead wires extending to motor 56 and switch 78, have been omitted from FIGS. 2–4 for purposes of clarity. 120 VAC input power for operation of indicator 10 and the various control output signals are fed to and from indicator 10 by cable 36 (FIG. 1). It will be understood that the various conductors of cable 36 are connected within indicator 10 to corresponding terminals on blocks 51,52, although such connections have been omitted from FIGS. 2–5 for purposes of clarity.

The "hot" side of 120 VAC input power received at terminal block 51 via cable 56 (FIG. 1) is connected through a fuse 200 and corresponding terminals of the mated connectors indicated generally at 202 to motor 54. Input power is also fed through connectors 202 to the common terminal of switch 78 (FIGS. 3 and 5). The normally closed and normally open terminals of switch 78 are respectively connected through connectors 202 and then through corresponding jumpers 204,206 (FIGS. 2 and 5) to one side of the actuating coil 208 of relay assembly 53. Both jumpers 204,206 are installed at the factory, one or the other of such jumpers being intended for removal upon installation of the bin level indicator for selecting either low level fail safe operation (removal of jumper 204) or high level fail safe operation (removal of jumper 206) in the manner to be described. The double pole contacts 210 of relay assembly 53 are connected to terminal block 52, and thence via cable 36 (FIG. 1) to remote indicating and/or control means (not shown).

The "neutral" side of 120 VAC input power is connected from terminal block 51 through a resistor 212 and connectors 202 to motor 54. The control or gate electrode of a triac 214 is connected to the juncture of resistor 212 and connectors 202 through a resistor 216. The primary current conducting electrodes of triac 214 are respectively connected to the neutral side of input power and the second side of relay actuating coil 208. The juncture of triac 214 and relay coil 208 is also connected to a terminal of block 51 for indicating a motor power failure via cable 36 (FIG. 1) as will be described. Switch 78 and relay switches 210 are illustrated in FIG. 5 in their respective normal positions when rotation of paddle 118 is unimpeded and motor 54 is in the position illustrated in FIG. 3. The purpose of connectors 202 is to permit rapid replacement of electronics assembly 44 without removing motor 54 and switch 78.

As previously indicated, jumpers 204 and 206 are for respectively selecting either high or low level fail safe operation in accordance with the present invention. The terms "high level fail safe" and "low level fail safe" have their usual meaning in the art and refer simply to the material level indication desired by an operator in the event of a power failure or the like. For example, if an operator is to position indicator 10 in the upper position of a bin to indicate a bin-full condition and would like the indicator to indicate a bin-full condition in the event of power or motor failure so that the bin would not overfill, he would select the high level fail safe mode of operation by removing jumper 206 prior to installation. It will be appreciated, of course, that "high" and "low" are taken with respect to indicator position in a tank, "high" being a material position at which rotation of paddle 118 is obstructed by material, and "low" being material positions at which paddle rotation is unobstructed.

In operation with 120 VAC power applied to terminal block 51, triac 214 is normally turned on through resistors 212,216 and motor 54 is normally energized through fuse 200. Assuming that high level fail safe operation has been selected as previously described, whereby jumper 206 has been removed while jumper 204 remains in place, the coil 208 of relay assembly 53 is normally energized through switch 78, jumper 204 and triac 214. When the material in the bin rises to the level of indicator 10 and rotation of paddle 118 is retarded, switch 78 is actuated as previously described, and relay assembly 53 is de-energized to provide an indication of a high material level via relay contacts 210, terminal block 52 and cable 36 (FIG. 1). If the material level subsequently falls below the level of the indicator and paddle 118 resumes rotation, switch 78 will return to the normal condition (FIG. 5) and relay 53 will be re-energized.

In the event of a power failure, again assuming selection of high level fail safe operation as described, relay coil 208 will be de-energized, indicating in effect a high material level independently of actual material level. Similarly, in the event that motor 54 or fuse 200 burns out, control power is removed from the gate of triac 214, the triac opens, operating in effect as an electronic switch, and coil 208 of relay 53 is de-energized to indicate a high material level condition independently of actual material level.

Assuming now that low level fail safe operation has been selected by removing jumper 204 and leaving jumper 206 in place, when material is above the level of the indicator and rotation of the paddle is retarded, relay 53 is energized through switch 78 (which is actuated to the normally open condition in FIG. 5 when paddle rotation is retarded) and jumper 206. When the material level falls below the indicator position and the paddle begins rotation, switch 78 assumes the position shown in FIG. 5 and relay 53 is de-energized. Likewise, relay 53 is de-energized by triac 214 in the event of a power, fuse or motor failure to indicate a low level condition independently of actual material level.

Thus, it will be appreciated in accordance with the invention that triac 214 cooperates with jumpers 204,206 and switch 78 to maintain relay 53 normally energized in the absence of the condition to be indicated, either high or low material level, and to de-energize relay 53 either upon actual occurrence of the material level of interest or upon occurrence of a failure condition.

Connection of the control electrode of triac 214 in the current path of motor 54 results in de-energization of relay 53 in the absence of motor current independently of the condition of switch 78 and independently of jumpers 204,206. Likewise, jumpers 204,206 cooperate with switch 78 normally to energize relay 53 in the absence of the material level of interest, so that a power failure, as well as a change in material level (or a motor or fuse failure) will be reflected by a de-energized relay.

The state of triac 214 provides an indication of proper motor operation independently of material level—i.e. triac 214 is in a conductive condition as long as power is applied and motor 54 is conducting current. Thus, the conductive condition of triac 214 may be remotely monitored by connecting a lamp 222, for example, between the hot side of input power and a cable conductor connected through terminal block 51 to the juncture of triac 214 and relay coil 208. When triac 214 is conducting, the hot and neutral sides of AC power will appear across the lamp and the lamp will be lit. In the event of motor or fuse failure, triac 214 becomes non-conducting and the lamp will be extinguished.

Although the invention has been described in detail in connection with a preferred embodiment thereof, any number of modifications may be effectuated without departing from the scope of the invention in its broadest aspects. For example, triac 214 could be replaced by another type of electronic switch, such as an electromagnetic relay having an actuator coil connected in series with motor 54 and a pair of normally open contacts connected in series with relay coil 208. Similarly, relay 53 could be replaced by solid state switches or the like, although electromagnetic relays are preferred in the art in this application by reason of the effective isolation of the relay contacts 210 from the remainder of the circuitry. Jumpers 204,206 could be replaced by a suitable single pole double pole switch located either within or remotely of indicator 10. However, it has been found as a practical matter that there is little, if any, demand in the art for provision of a feature whereby a particular unit may be switched between high and low level fail safe during the lifetime of the unit.

It will also be apparent that the fail safe feature of the invention is not limited to the particular presently preferred embodiment of indicator shown in the drawings, and may as readily be incorporated in the indicators disclosed in the above-referenced Fleckenstein and Levine patents, for example, where the switches for detecting limited counter-rotation of the paddle drive motor are fixedly carried in the indicator housing. Likewise, the invention is not limited to rotating paddle units wherein limiting of paddle rotation results in limited rotary motion of the drive motor. Other mechanical motion or counter motion could as well be utilized to actuate switch 78.

Thus, in accordance with a first important aspect for maintaining the level indicating first relay means 53 normally energized so long as power is applied to the unit and the material has not reached or assumed the preselected actual condition of interest, i.e., either high or low level, the present invention contemplates operator-selectable switch means, specifically jumpers 204,206, in combination with double pole sensing switch for normally establishing a current path through the first relay means. In accordance with a second important aspect, a second relay means, i.e., triac 214, is responsive to continued current flow through motor 54, indicative of continued application of power through fuse 200 and continuity through the motor windings, for maintaining the current path through the level indicating first relay means. Thus, these first and second aspects of the invention combine to provide a rotating paddle bin level which includes an operator selectable fail safe feature for indicating either a high level or low level material condition in the event of power or motor failure and independently of the actual material level.

The invention claimed is:

1. Apparatus for indicating the level of material in a storage bin comprising a hollow enclosure including means for mounting said enclosure to a storage bin, motor means mounted for limited movement within said enclosure, a paddle operatively coupled to said motor means and adapted to be disposed for rotation within said bin, rotation of said paddle being retarded when material stored in said bin is at a level so as to stallably engage said paddle, means mounted within said enclosure for detecting limited movement of said motor means when rotation of said paddle is retarded by material stored in said bin, and fail safe means operatively connected to said means for detecting limited movement for indicating a preselected material level condition at said means for detecting limited movement in the event of failure at said apparatus independently of actual material level relative to said paddle.

2. The apparatus set forth in claim 1 wherein said means for detecting said limited movement comprises first relay means and circuit means for normally energizing said first relay means in the absence of said preselected material level condition, and wherein said fail safe means comprises means for de-energizing said first relay means in the event of a failure at said apparatus.

3. The apparatus set forth in claim 2 wherein said means for detecting said limited movement comprises first switch means responsive to said limited movement for switching between first and second switch conditions, and second switch means operatively connecting said first switch means for energizing said first relay means in a preselected one of said first and second switch positions corresponding to said preselected material level condition.

4. The apparatus set forth in claim 3 wherein said first switch means comprises a switch having a common contact connected to receive electrical power, a normally open contact and a normally closed contact, and wherein said second switch means comprises means for selectively connecting one of said normally open and normally closed contacts to said first relay means.

5. The apparatus set forth in claim 4 wherein said first relay means comprises an electromagnetic relay having an actuator coil connected to receive electrical power through said first and second switch means, and relay contact means responsive to removal of electrical power from said relay coil for indicating said preselected material level condition.

6. The apparatus set forth in claim 2, 3 or 4 wherein said fail safe means further comprises means responsive to flow of current through said motor means for de-energizing said first relay means in the event of interruption of said current flow.

7. The apparatus set forth in claim 6 wherein said means responsive to current flow comprises second relay means including second relay actuator means coupled to said motor and responsive to current flow through said motor means, and second relay switch means connected in circuit with said first relay means.

8. The apparatus set forth in claim 7 wherein said second relay means comprises a solid state relay having a control electrode coupled to said motor means and primary current conducting electrodes connected in circuit with said first relay means.

* * * * *